US007073273B2

(12) United States Patent
Kim

(10) Patent No.: US 7,073,273 B2
(45) Date of Patent: Jul. 11, 2006

(54) LOW TEMPERATURE DRYER

(76) Inventor: Eui-Seob Kim, # 245 Warren Blvd., Broomall, PA (US) 19008

( * ) Notice: Subject to any disclaimer, the term of this patent is extended or adjusted under 35 U.S.C. 154(b) by 0 days.

(21) Appl. No.: 10/817,894

(22) Filed: Apr. 6, 2004

(65) Prior Publication Data

US 2005/0204583 A1 Sep. 22, 2005

(30) Foreign Application Priority Data

Mar. 16, 2004 (KR) ..... 10-2004-0017519

(51) Int. Cl.
*F26B 11/02* (2006.01)

(52) U.S. Cl. ..... 34/595

(58) Field of Classification Search ..... 34/595
See application file for complete search history.

(56) References Cited

U.S. PATENT DOCUMENTS 4,532,720 A * 8/1985 Uchida ..... 34/471
2004/0010937 A1* 1/2004 Naganawa et al. ..... 34/595

* cited by examiner

*Primary Examiner*—S. Gravini

(74) *Attorney, Agent, or Firm*—Ladas & Parry LLP

(57) ABSTRACT

The present invention relates to a low temperature dryer which can dry the washing while preventing damage or deformation of the washing. The low temperature dryer, includes a drum unit 10 having a drum 11 in which the washing is contained, wherein the drum 11 rotates; a circulation duct 20 that communicates one side and the other side of the drum unit 10; a refrigerator 30 including an dehumidification evaporator 31 disposed at one side within the circulation duct 20 wherein the dehumidification evaporator 31 dehumidifies air passing through it, a compressor 32 for compressing a coolant via the dehumidification evaporator 31, and a condenser 33 for discharging heat of the coolant via the compressor 32; a first heater 40 disposed at the other side within the circulation duct 20, for heating air passing through it; a blowing fan 50 connected to the circulation duct 20, wherein the blowing fan allows the air discharged from the drum unit 10 to pass through the dehumidification evaporator 31 and the first heater 40 and to be introduced into the drum unit 10 again; and a drain valve 60 for discharging the water dehumidified by the dehumidification evaporator 31 toward the outside.

3 Claims, 3 Drawing Sheets

LOW TEMPERATURE DRYER

BACKGROUND OF THE INVENTION

1. Field of the Invention

The present invention relates to a low temperature dryer capable of drying the washing even in a room temperature state.

2. Related Prior Art

A dryer is an apparatus for drying the washing. The dryer mainly includes a drum for containing the washing, which rotates, and a high wind unit for supplying a high wind to the inside of the drum. If it is desired to dry the washing, a high wind of a high temperature is blown into the drum to dry the washing in a state where the drum rotates. However, if it is desired to dry the washing using a high wind of a high temperature, a texture of the washing may be shrank or deformed, thus causing lots of damage to the washing. In this case, if a temperature of a high wind is lowered, there is a problem that the washing may not be dried or a dry time may be very lengthened.

SUMMARY OF THE INVENTION

Accordingly, the present invention has been made in view of the above problems, and it is an object of the present invention to provide a low temperature dryer capable of preventing damage of the washing and shortening the dry time in a dry process.

To achieve the above objects, according to the present invention, there is provided a low temperature dryer, comprising drum unit 10 having a drum 11 for containing the washing, which rotates; a circulation duct 20 that communicates one side and the other side of the drum unit 10; a refrigerator 30 including an dehumidification evaporator 31 disposed at one side within the circulation duct 20 wherein the dehumidification evaporator 31 dehumidifies air passing through it, a compressor 32 for compressing a coolant via the dehumidification evaporator 31, and a condenser 33 for discharging heat of the coolant via the compressor 32; a first heater 40 disposed at the other side within the circulation duct 20, for heating air passing through it; a blowing fan 50 connected to the circulation duct 20, wherein the blowing fan allows the air discharged from the drum unit 10 to pass through the dehumidification evaporator 31 and the first heater 40 and to be introduced into the drum unit 10 again; and a drain valve 60 for discharging the water dehumidified by the dehumidification evaporator 31 toward the outside.

The low temperature dryer further comprises an exhaust duct 70 that communicates with one side of the drum unit 10 and communicates with the outside, a suction duct 80 that communicates with the other side of the drum unit 10 and communicates with the outside, a suction fan 90 for generating a suction pressure that introduces air into the drum unit 10 through the suction duct 80 and discharges it to the exhaust duct 70, and first and second valves V1 and V2 disposed in the exhaust duct 70 and the suction duct 80, respectively.

In the above, the exhaust duct 70 has a second heater 75 for heating an introduced air.

The first heater 40 and/or the second heater 75 or/are heated by steam.

The circulation duct 20 comprises a filter 21 for filtering an alien substance contained in the circulating air.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 1:
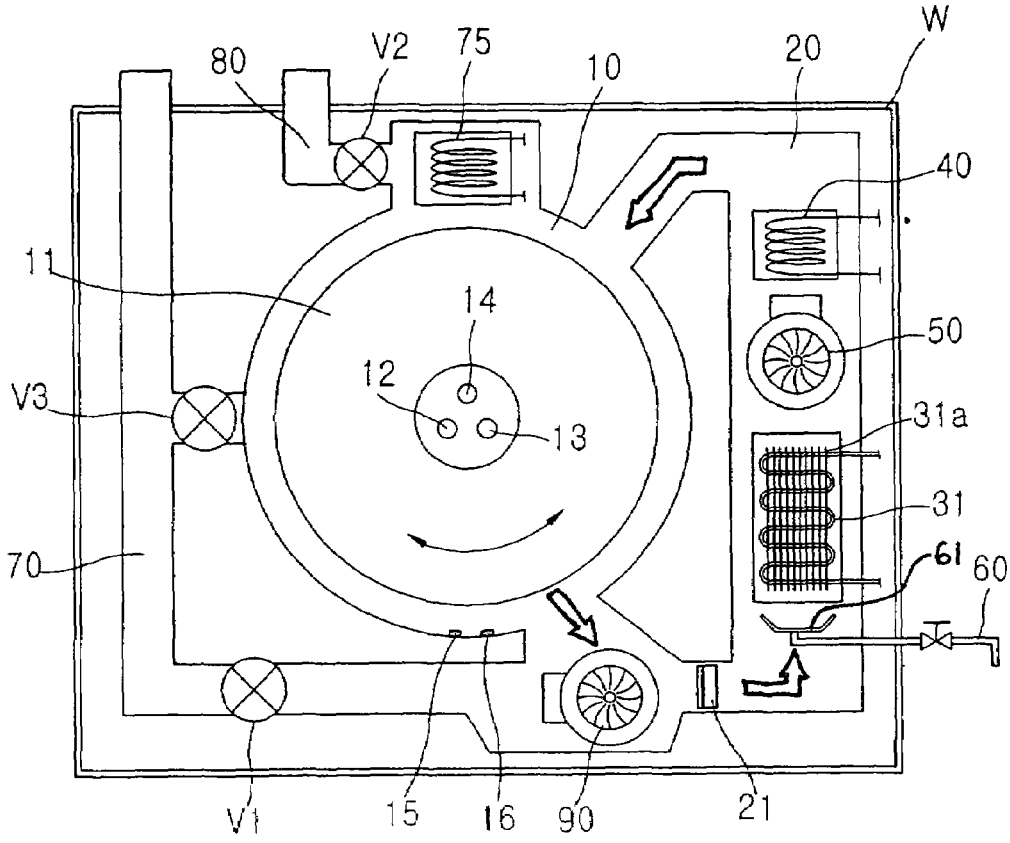
FIG. 1 shows the flow of an internal air upon the dry in a low temperature dryer according to the present invention.
Figure 2:
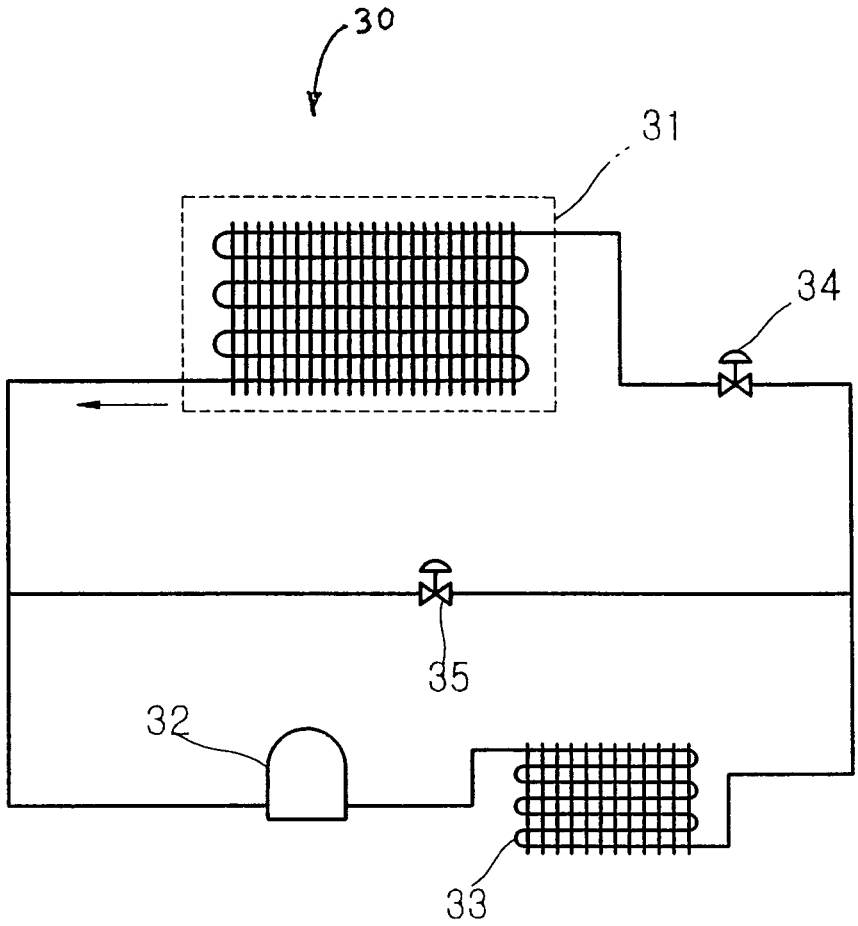
FIG. 2 shows the construction of the cooling device shown in FIG. 1.
Figure 3:
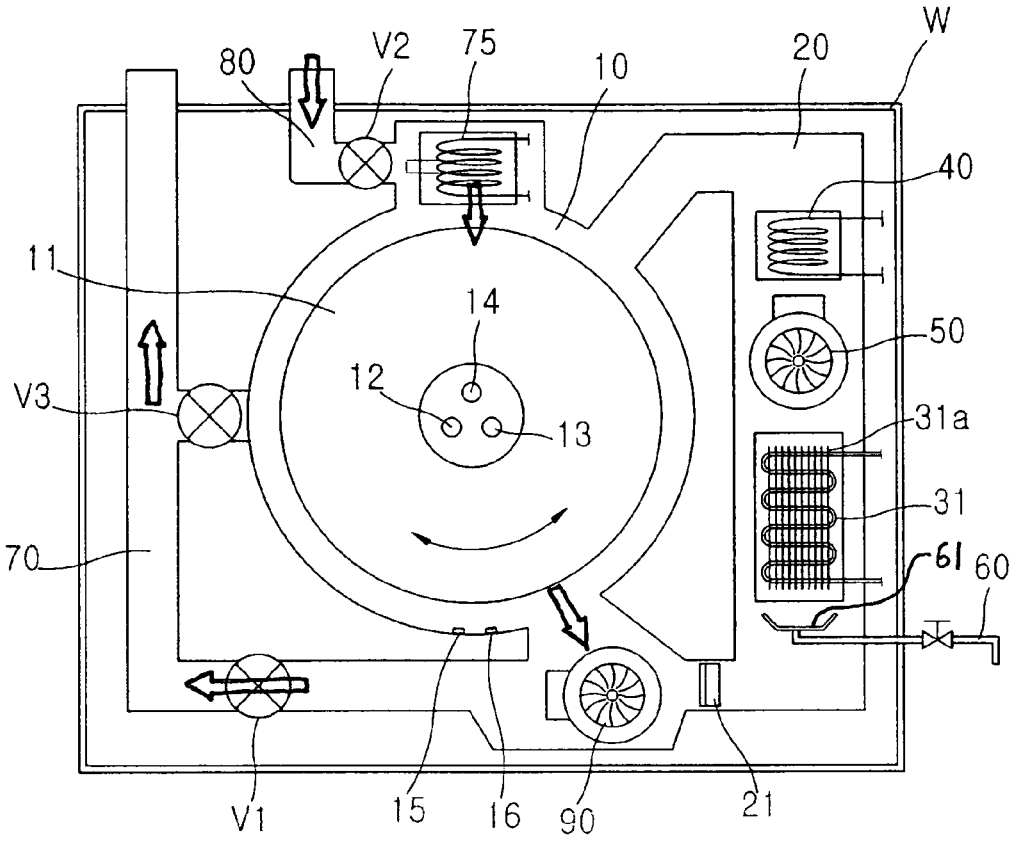
FIG. 3 shows the air flow when an external air is introduced in FIG. 1.

FIG. 1 shows the flow of an internal air upon the dry in a low temperature dryer according to the present invention, FIG. 2 shows the construction of the cooling device shown in FIG. 1, and FIG. 3 shows the air flow when an external air is introduced in FIG. 1.

Referring to FIG. 1 to FIG. 3, the low temperature dryer according to the present invention includes a drum unit 10 having a drum 11 that rotates, a circulation duct 20 that communicates one side and the other side of the drum unit 10, a refrigerator 30 having an dehumidification evaporator 31 disposed in the circulation duct 20, a first heater 40 disposed at the other side within the circulation duct 20, for heating air passing through it, a blowing fan 50 for allowing the air discharged from the drum unit 10 to pass through the dehumidification evaporator 31 and the first heater 40 and to be introduced into the drum unit 10 again, and a drain valve 60 for discharging the water dehumidified by the dehumidification evaporator 31 toward the outside.

The low temperature dryer further includes an exhaust duct 70 that communicates with one side of the drum unit 10 and communicates with the outside, a suction duct 80 that communicates with the other side of the drum unit 10 and communicates with the outside, a suction fan 90 for generating a suction pressure that introduces air into the drum unit 10 through the suction duct 80 and discharges it to the exhaust duct 70, and first and second valves V1 and V2 disposed in the exhaust duct 70 and the suction duct 80, respectively. Furthermore, a third valve V3 for introducing air directly into the inside or outside of the drum unit is disposed between the exhaust duct 70 and the drum unit 10. In the above, all the components are disposed in a body W and are controlled by a microprocessor (not shown).

The washing is contained in the drum 11 that rotates within the drum unit 10. A door (not shown) for precluding the drum unit 10 from the outside is disposed in the body W. The door is opened or closed by a cylinder (not shown) disposed at a predetermined portion of the door. If the door is closed, the inside of the drum unit is completely isolated from the outside.

A large number of air holes for facilitating communication of internal and external air are formed in the circumference of the drum 11.

Medicine spray nozzles 12 and 13 that spray medicines for removing the smell of the washing may be disposed within the drum 11. The medicine spray nozzles 12 and 13 are connected to a heterogeneous medicines barrel (not shown) disposed at a predetermined portion of the body W.

Predetermined medicines may be sprayed into the drum 11, if necessary. The medicine spray nozzles may be, for example, two in number.

A pressurized air spray nozzle 14 for spraying a pressurized air to the washing may be disposed in the drum 11. The pressurized air spray nozzle 14 is connected to an external compressor (not shown). The pressurized air spray nozzle 14 rapidly sprays a pressurized air to the inside of the drum unit 10 when a temperature of the drum unit is different from a predetermined value, thereby making the temperature within the drum unit 10 equal to the predetermined temperature and thus increasing dry efficiency.

A temperature sensor 15 for sensing a temperature within the drum unit 11 and a moisture sensor 16 for sensing humidity within the drum unit 11 are disposed within the drum unit 11. The temperature sensor 15 and the moisture sensor 16 compare detected temperature and humidity of the drum unit 10 with reference values during the dry process and transmit their difference values to the microprocessor, which controls the aforementioned elements based on the difference values. The temperature sensor 15 and the moisture sensor 16 can calculate and detect the amount of moisture that remains in the washing and can provide information on which a temperature of air, the direction and rotation speed of the drum 11, an accelerating speed (accelerating time) and the like are comprehensively considered.

The circulation duct 20 forms a passage along which air circulates from one side of the drum unit 10 to the other side thereof. At this time, the circulation duct 20 has a filter 21 for filtering an alien substance contained in the circulating air. At this time, the circulation duct 20 is disposed so that the air passing through the circulation duct 20 is sprayed toward the front inlet of the drum 11.

The refrigerator 30 includes an dehumidification evaporator 31 disposed within the circulation duct 20, a compressor 32 for compressing a coolant via the dehumidification evaporator 31, a condenser 33 for discharging heat of the coolant via the compressor 32, an expansion valve 34 for lowering a high pressure of a coolant liquid introduced into the dehumidification evaporator 31 so that the liquid can be easily evaporated, and a bypass valve 35 for guiding the coolant discharged from the condenser 33 directly to the compressor 32. At this time, a plurality of radiation pins 31*a* for widening a contact area with air are disposed in the dehumidification evaporator 31. In such a refrigerator, a liquid coolant of a high pressure discharged from the condenser 33 becomes a low pressure through the expansion valve 34, thus absorbing surrounding latent heat while being evaporated in the dehumidification evaporator 31, and the dehumidification evaporator 31 therefore lowers a temperature and humidity of the air via the evaporator 31. Thereafter, a gaseous coolant of a high temperature and a low pressure that absorbs heat becomes a gas of a high temperature and a high pressure, while passing through the compressor 32, and then passes through the condenser 33. Heat of the high temperature forms a cooling cycle, which becomes a liquid state of a high pressure, while becoming cool by an open air. As heat is absorbed from the air within the drum unit 10 and steam is removed through this process, the temperature and humidity are lowered.

The first heater 40 heats the air, which becomes cool via the dehumidification evaporator 31, and thus increases a saturation steam pressure. In this embodiment, such a heater has a type in which air is heated by steam supplied externally. However, this is only an embodiment and the heater may have a type using an electric furnace.

The blowing fan 50 may have a variety of types such as a Sirocco type.

The drain valve 60 is connected to a drainage tube 61 for storing water dehumidified by the dehumidification evaporator 31 therein. If sufficient water is stored in the drainage tube 61, the drain valve 60 is discharged toward the outside.

The exhaust duct 70 and the suction duct 80 are operated in cooperation with the first and second valves V1 and V2 and the suction fan 90. If the first and second valves V1 and V2 are opened and the suction fan 90 is driven, the exhaust duct 70 and the suction duct 80 lower the pressure on the part of the exhaust duct 70 so that an external air is introduced into the inside of the drum unit 10 via the suction duct 80. At this time, the first and second valves V1 and V2 employ a valve so called a damper. The damper is a plate that rotates within the duct. As the duct rotates, the area of an oil passage within the duct is adjusted and the amount of air flowing within the duct is thus controlled.

In a case where the low temperature dryer is used in the laundry, the first heater 40 or the second heater 75 is connected to a steam line (not shown) for supplying steam and the pressurized air spray nozzle 14 is connected to a high-pressure air supply line (not shown) connected to a compressor.

The operation of the low temperature dryer constructed above will now be described.

After the washing is introduced into the drum 11 of the drum unit 10, the door is closed to exclude an external air. The refrigerator 30 is then driven to lower a temperature of the radiation pin 31*a* in the dehumidification evaporator 31 to about −4° C. and the blowing fan 50 is then driven to allow air within the drum unit 10 to circulate through the circulation duct 20.

The air circulating through the circulation duct 20 is lowered to about 2° C., while passing through the dehumidification evaporator 31. Therefore, as a saturation steam pressure is lowered, steam in the air forms dew on the dehumidification evaporator 31. In other words, steam in the air is removed. Furthermore, a temperature of the cooled air from which the steam is removed is increased to about 10° C. via the first heater 40 and a saturation steam pressure is thus increased.

The air from which the steam is removed while circulating through the circulation duct 20 and whose saturation steam pressure becomes high due to the increased temperature, is again introduced into the drum unit 10 and is mixed with the washing. Through this process, moisture contained in the washing is dried while being discharged to air.

At this time, the temperature sensor 15 and the moisture sensor 16 at the lower side of the drum unit 10 detect a temperature and humidity within the drum 11 at an interval of 1 second and compare the detected values with reference values. If there is a difference in the temperature and humidity, the first heater 40 and the refrigerator 30 are controlled to increase the humidity removal capability of the dehumidification evaporator 31. By repeating this process for 10 to 20 minutes, it is possible to reduce the amount of moisture remaining in the washing by over about 30% to 50%.

Meanwhile, in order to more effectively perform the dry, after the process is performed, the operation of the refrigerator 30 and the blowing fan 50 is stopped and the first and second valves V1 and V2 are opened while driving the suction fan 90.

By doing so, an external air is introduced via the suction duct 80. The air is heated by the second heater 75 and is then introduced into the drum unit 10, increasing a temperature of moisture remaining in the washing. At this time, the drum 11 is slowly rotated so that the washing is not closely adhered to the circumferential surface of the drum 11 due to the centrifugal force. This is because if the drum 11 is rapidly rotated, the washing is closely adhered to the circumferential surface of the drum 11 due to the centrifugal force and air holes of the circumferential surface are thus clogged to stop the air flow. Thereafter, while the above process is repeatedly performed, the dry proceeds.

As described above, as a refrigerator and first and second heaters are used, steam in air mixed with the washing is effectively removed at low temperature. Therefore, it is possible to fundamentally prevent shrinkage, deformation or generation of damage to the washing in the dry process.

Furthermore, according to the present invention, steam in air is removed by means of a saturation steam pressure. It is thus possible to dry the washing within a short time, compared to a conventional method using a high wind.

While the present invention has been described with reference to the particular illustrative embodiments, it is not to be restricted by the embodiments but only by the appended claims.

What is claimed is:

1. A low temperature dryer, comprising:

a drum unit having a drum for containing the washing, wherein the drum rotates;

a circulation duct that communicates one side and the other side of the drum unit;

a refrigerator, wherein the refrigerator comprises an dehumidification evaporator disposed at one side within the circulation duct, the dehumidification evaporator dehumidifying air passing through it, a compressor for compressing a coolant via the dehumidification evaporator and a condenser for discharging heat of the coolant via the compressor;

a first heater disposed at the other side within the circulation duct for heating air passing through it;

a blowing fan connected to the circulation duct, wherein the blowing fan allows the air discharged from the drum unit to pass through the dehumidification evaporator and the first heater and to be introduced into the drum unit again;

a drain valve for discharging the water dehumidified by the dehumidification evaporator toward the outside; and an exhaust duct that communicates with one side of the drum unit and communicates with the outside, a suction duct that communicates with the other side of the drum unit and communicates with the outside, a suction fan for generating a suction pressure that introduces air into the drum unit through the suction duct and discharges it to the exhaust duct, and first and second valves and disposed in the exhaust duct and the suction duct, respectively, wherein the exhaust duct has a second heater for heating an introduced air.

2. The low temperature dryer as claimed in claim 1, wherein the first heater and/or the second heater are/or heated by steam.

3. The low temperature dryer as claimed in claim 1, wherein the circulation duct comprises a filter for filtering an alien substance contained in the circulating air.

* * * * *